US006527137B1

(12) United States Patent
Kleckauskas et al.

(10) Patent No.: US 6,527,137 B1
(45) Date of Patent: Mar. 4, 2003

(54) DRINKING MUG WITH INTEGRAL STRAW

(75) Inventors: Robert Kleckauskas, St. Charles, IL (US); Bruce Ronner, Glencoe, IL (US); Robert Giacolo, Woodridge, IL (US); David W. Heidlauf, Libertyville, IL (US)

(73) Assignee: Arrow Plastic Manufacturing Co.

( * ) Notice: Subject to any disclaimer, the term of this patent is extended or adjusted under 35 U.S.C. 154(b) by 0 days.

(21) Appl. No.: 09/695,541

(22) Filed: Oct. 24, 2000

(51) Int. Cl.[7] ..... B65D 3/00

(52) U.S. Cl. ..... 220/705; 220/710; 215/388; D7/509; D7/510

(58) Field of Search ..... 220/705, 710, 220/710.5; D7/509, 510, 533, 536; 215/388

(56) References Cited

U.S. PATENT DOCUMENTS

| | | | | |
|---|---|---|---|---|
| 307,297 | A | | 10/1884 | Habenicht |
| D65,527 | S | | 9/1924 | Graham |
| D94,000 | S | | 12/1934 | Sebring |
| D96,566 | S | | 8/1935 | Straus |
| 2,355,010 | A | | 8/1944 | Pera |
| 2,599,919 | A | | 6/1952 | Hucknall |
| 2,687,628 | A | | 8/1954 | Cunningham |
| 2,747,387 | A | | 5/1956 | Sweem |
| D185,971 | S | | 8/1959 | Saffer |
| D186,535 | S | | 11/1959 | Saffer |
| D232,797 | S | | 9/1974 | Doolittle |
| D242,416 | S | | 11/1976 | Achenbach |
| D243,816 | S | | 3/1977 | Achenbach |
| 4,016,998 | A | | 4/1977 | Finch |
| 4,239,175 | A | | 12/1980 | Straubinger |
| D269,578 | S | | 7/1983 | Straubinger |
| D285,035 | S | | 8/1986 | Petrasek |
| D292,462 | S | | 10/1987 | Petrasek |
| D292,463 | S | | 10/1987 | Petrasek |
| D292,464 | S | | 10/1987 | Petrasek |
| 4,953,725 | A | * | 9/1990 | Buj ..... 220/710 X |
| 5,199,633 | A | * | 4/1993 | Jantzen et al. ..... 220/710 X |
| D340,836 | S | | 11/1993 | Cautereels |
| D347,763 | S | | 6/1994 | Kleckauskas et al. |
| D407,946 | S | | 4/1999 | Brewer et al. |

* cited by examiner

*Primary Examiner*—Steven M. Pollard
(74) *Attorney, Agent, or Firm*—Rockey, Milnamow & Katz, Ltd.

(57) ABSTRACT

A drinking mug with integral straw includes a cup-like vessel portion, and a straw portion having an internal passage joined in fluid communication with an interior volume of the vessel portion. The straw portion is preferably positioned in spaced apart relationship to the vessel portion, whereby the straw portion can be easily gripped for holding the mug during use. Notably, the straw portion includes a plurality of subdivisions in the internal passage arranged in series flow relationship, with each of the subdivisions including a pair of sections through which liquid can flow. Thus, as liquid is drawn through the straw portion from the vessel portion, the liquid flow is repeatedly subdivided and joined as liquid flows through the series of subdivisions. By formation of the present drinking mug from transparent plastic material, the flow of liquid from the vessel portion through the straw portion is readily visually apparent, thus enhancing enjoyable use of the article.

12 Claims, 1 Drawing Sheet

DRINKING MUG WITH INTEGRAL STRAW

TECHNICAL FIELD

The present invention relates generally to a molded plastic drinking mug having an integral, built-in straw, and more particularly to a mug with an integral straw, wherein the straw includes a plurality of subdivisions or bifurcations in an internal passage defined thereby, whereby liquid can flow in parallel flow relationship through a pair of sections of the internal passage for enhanced visual appeal.

BACKGROUND OF THE INVENTION

Drinking mugs with integral, built-in straws have proven very popular with consumers. As exemplified by U.S. Design Pat. No. Des. 347,763, hereby incorporated by reference, a mug-like drinking vessel of this type includes a cup-like portion for receiving liquid, and an integral straw which extends upwardly generally from the lower end of the cup portion. In one form which has proven to be very commercially successful, the straw is spaced from the body of the cup portion, whereby the straw can be conveniently grasped to serve as a handle during use. A vented screw cap is removably secured to the cup portion, and desirably acts to abate spilling of the contents during consumption.

The above-described drinking vessel has proven particularly popular with children, by virtue of its easy-to-grip configuration, and fanciful configuration. Manufacture from transparent material enhances the visual appeal of the article, and permits observation of liquid being drawn from the cup portion upwardly through the integral straw. With this in mind, the present drinking mug has been particularly configured to facilitate convenient use, especially by children, with the configuration of the integral straw further enhancing its aesthetic appeal.

SUMMARY OF THE INVENTION

A drinking mug or cup with an integral straw embodying the principles of the present invention has been particularly configured to facilitate convenient and enjoyable use by children, as well as other consumers. Notably, the mug is configured to facilitate convenient gripping, and preferably includes a removable cap to minimize spilling of the cup's contents. Of particular note is the configuration of the straw of the mug, which includes a plurality of subdivisions or bifurcations in an internal passage defined thereby, such that as liquid flows through the straw, it is subdivided into parallel flow sections, which join each other intermediate adjacent ones of the subdivisions. When formed from transparent plastic material in accordance with the preferred form, this subdivision, and joining of the liquid flow is readily visible, thus greatly enhancing the visual appeal of the mug during use.

In accordance with the illustrated embodiment, the present drinking mug includes a generally cup-shaped vessel portion having a bottom wall, and an upstanding side wall. The side wall extends upwardly from the bottom wall, and defines an interior volume therewith for receiving liquid in the vessel portion.

The drinking mug further includes an integral straw portion joined to the vessel portion in spaced apart relationship, whereby the drinking mug can be easily gripped by grasping the straw portion. The straw portion defines an internal passage joined in fluid communication with the interior volume of the vessel portion so that liquid can be drawn through the straw portion from the vessel portion.

Notably, the straw portion defines at least one subdivision or bifurcation in the internal passage so that liquid can flow in parallel flow relationship through a pair of sections of the internal passage. In the preferred form, the two sections of the internal passage join each other to define a single flow path between adjacent ones of the subdivisions, and at the upper extent of the straw portion which extends from the uppermost one of the subdivisions. Thus, as liquid is drawn through the straw portion, the liquid flow is subdivided, then joined together as it flows from the vessel portion. In the preferred form, including a plurality of subdivisions in the internal passage arranged in series-flow relationship, this subdivision and joining of the liquid flow is repeated as the liquid moves upwardly through the straw portion.

In the preferred embodiment, each subdivision in the straw portion has a generally circular configuration, whereby each of the sections of the internal passage have a generally semi-circular configuration. Each of the subdivisions of the straw portion further preferably includes a web portion extending integrally between the sections of the internal passage. When formed of transparent material in accordance with the preferred form, this movement of the liquid through the semi-circular sections of the passage, on respective opposite sides of each window-like web portion, is readily visible.

The configuration of the vessel portion of the present drinking mug also facilitates convenient gripping during use. In the preferred form, the vessel portion includes a plurality of vertically spaced indentations respectively aligned with portions of the straw portion positioned between adjacent ones of the subdivisions. By this configuration, the straw portion and the vessel portion together define a plurality of finger grip openings which facilitate insertion of fingers therethrough whereby the straw portion can be easily gripped. The straw portion preferably includes a support strut joined to the vessel portion in spaced apart relationship to the bottom wall, thereby assuring the integrity of the structure, and secure gripping of the drinking mug when filled. A cap removably secured to the vessel portion is preferably provided at the upper extent of the side wall to limit spilling of the contents of the mug.

Other features and advantages of the present invention will become readily apparent from the following detailed description, the accompanying drawings, and the appended claims.

DETAILED DESCRIPTION

Figure 2:
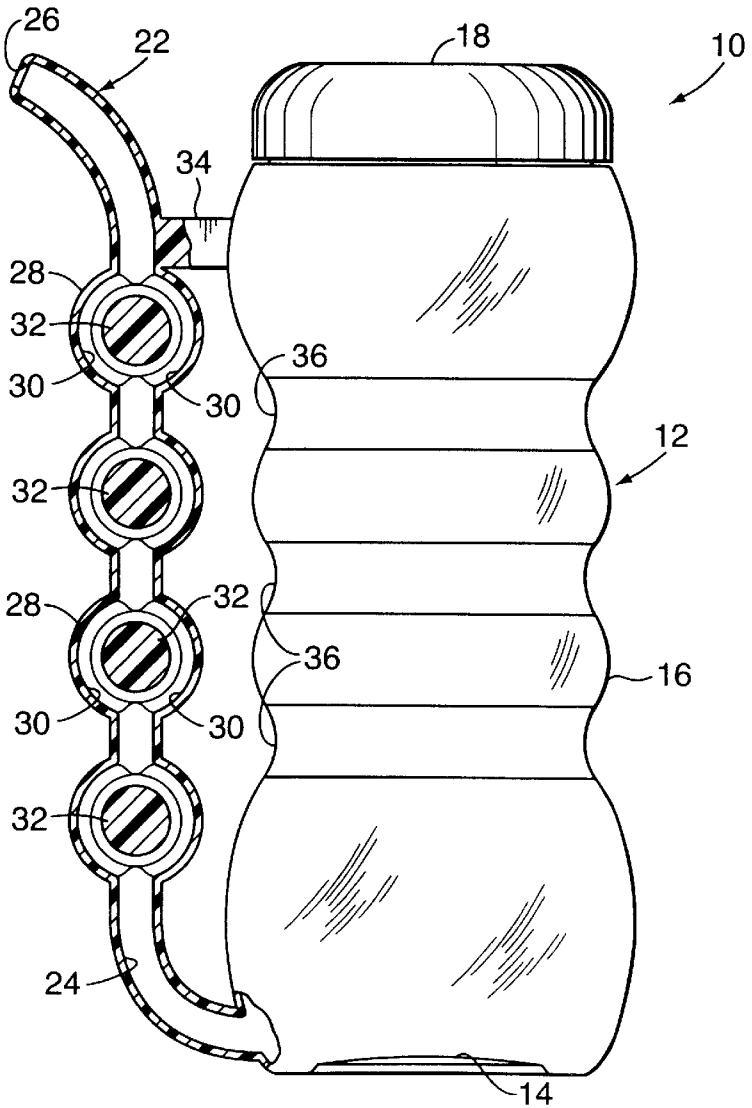
FIG. 2 is a side elevational view, in partial cross-section, of the drinking mug shown in FIG. 1.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

Figure 1:
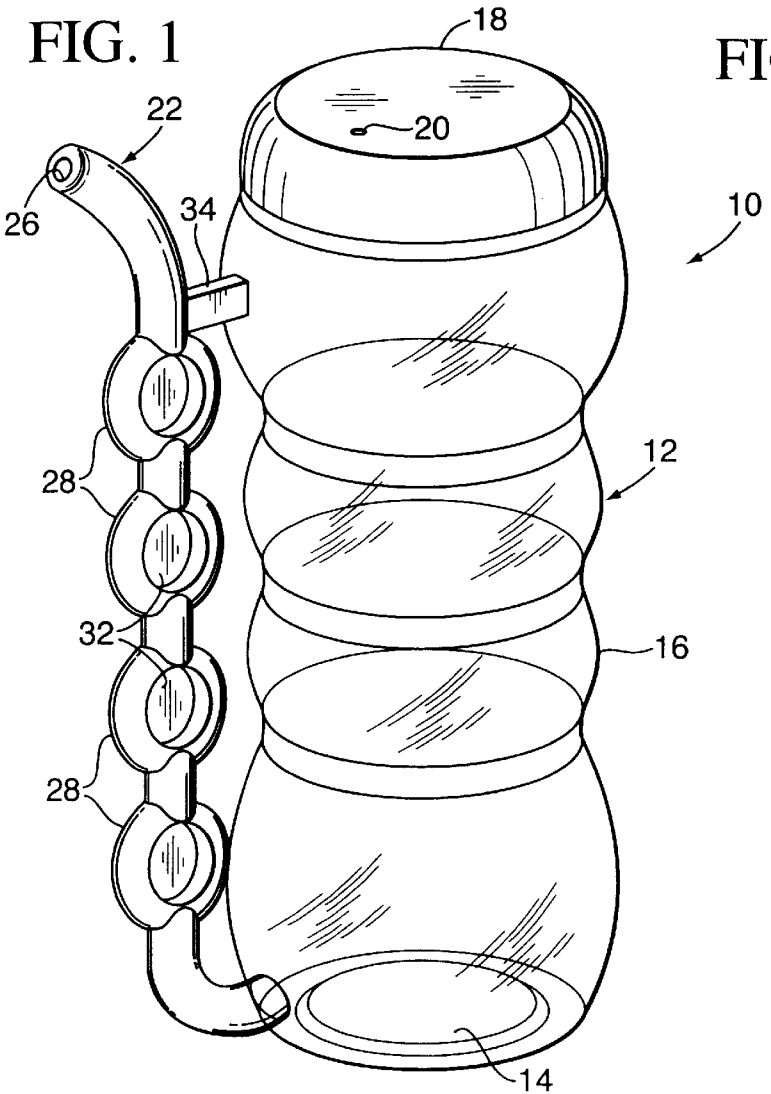
FIG. 1 is a perspective view of a drinking mug with an integral straw embodying the principles of the present invention.

With reference to FIGS. 1 and 2, therein is illustrated a drinking mug or cup 10 embodying the principles of the present invention. The drinking mug 10 includes a cup-like vessel portion 12 having a bottom wall 14, and an upstanding side wall 16 extending upwardly from bottom wall 14. The bottom wall 14 and side wall 16 together define an interior volume of the vessel portion 12 for receiving liquid therein. To this end, the drinking mug 10 preferably includes a removable cap 18 which can be screw-fitted or otherwise removably secured to the side wall 16 at the upper extent thereof. A vent opening 20 defined by the cap permits ingress of air into the vessel portion as its contents are drawn therefrom, with the provision of the cap desirably serving to abate spillage of the contents of the vessel portion.

The present drinking mug further includes an integral straw portion 22 joined to the vessel portion 12 through which liquid can be drawn from the vessel portion for consumption. To this end, the straw portion 22 defines an internal passage 24 joined in fluid communication with the interior volume of the vessel portion 12. Liquid flows through the internal passage 24 of the straw portion and out of an opening 26 as it is drawn into the mouth of the user.

Notably, the straw portion 22 includes at least one, and preferably a plurality of vertically spaced subdivisions 28 in the internal passage 24 defined thereby. As illustrated, each of the subdivisions 28 preferably has a generally circular configuration, with each subdivision acting to subdivide or bifurcate the internal passage into a pair of semi-circular sections 30 through which liquid can flow in parallel flow relationship. In the illustrated embodiment, each of the subdivisions 28 includes a web portion 32 which extends between the respective sections 30.

The subdivisions 28 of the straw portion 22 are arranged in series-flow relationship, with liquid flowing through the internal passage 24 thus repeatedly subdivided, then joined together, as the liquid flows through the respective pairs of sections 30. In accordance with the illustrated embodiment, the vessel portion 12 and straw portion 22 are preferably formed from transparent plastic material, and thus the flow of liquid from the vessel portion and through the subdivisions of the straw portion 22 is readily visually apparent. An aesthetically pleasing effect is thus created as liquid is drawn upwardly through the straw portion, about each of the window-like web portions 32 as it is consumed.

By the provision of a plurality of the generally circular subdivisions 28 of the straw portion 22, the straw portion is provided with a hand grip-like configuration, thus facilitating grasping of the drinking mug during use. The stability and integrity of the structure is enhanced by the preferred provision of the straw portion 22 with a support strut 34, spaced from bottom wall 14, joining the straw portion to the vessel portion 12. Grasping of the drinking mug is further facilitated by configuring the vessel portion 12 to includes a plurality of vertically spaced indentations 36 respectively aligned with portions of the straw portion 22 positioned between adjacent ones of the indentations 36. The straw portion 22 and vessel portion 12 thus together define a plurality of finger openings facilitating gripping of the straw portion.

From the foregoing, numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A drinking mug with integral straw, comprising:

a generally cup-shaped vessel portion having a bottom wall, and an upstanding side wall extending upwardly from said bottom wall, and defining an interior volume therewith for receiving liquid in the vessel portion; and an integral straw portion joined to said vessel portion in spaced apart relationship whereby said drinking mug can be gripped by grasping said straw portion;

said straw portion defining an internal passage joined in fluid communication with said interior volume so liquid can be drawn through said straw portion;

said straw portion defining at least one subdivision in said internal passage so that liquid can flow in parallel flow relationship through a pair of sections of said internal passage of said straw portion.

2. A drinking mug in accordance with claim 1, wherein:

said two sections of said internal passage at said subdivision join each other to define a single flow path.

3. A drinking mug in accordance with claim 2, wherein:

said straw portion defines plural ones of said subdivisions of said internal passage arranged in series flow relationship with each other, each subdivision providing a respective pair of said sections of said internal passage respectively arranged in parallel flow relationship, each adjacent pair of said subdivisions being joined by a respective one of said single flow paths.

4. A drinking mug in accordance with claim 1, wherein:

said subdivision of said straw portion has a generally circular configuration, each of said sections of said internal passage having a generally semi-circular configuration.

5. A drinking mug in accordance with claim 4, wherein:

each of said subdivisions of said straw portion includes a web portion extending integrally between said sections of said internal passage.

6. A drinking mug in accordance with claim 1, wherein:

said straw portion includes a support strut joined to said side wall of said vessel portion in spaced apart relationship to said bottom wall.

7. A drinking mug with integral straw, comprising:

a generally cup-shaped vessel portion having a bottom wall, and an upstanding side wall extending upwardly from said bottom wall and defining an interior volume therewith; and a straw portion joined to said vessel portion, said straw portion defining an internal passage joined in fluid communication with said interior volume said straw portion defining a plurality of subdivisions in said internal passage arranged in series flow relationship with each other, each of said subdivisions including a pair of sections of said internal passage arranged in parallel flow relationship.

8. A drinking mug in accordance with claim 7, wherein:

said straw portion is joined in spaced apart relationship to said vessel portion, and includes a support straw joined to said vessel portion in spaced apart relationship to said bottom wall.

9. A drinking mug in accordance with claim 8, wherein:

said vessel portion defines a plurality of indentations respectively aligned with portions of said straw portion positioned between adjacent ones of said subdivisions, whereby said strut portion and said vessel portion together define a plurality of finger grip openings.

10. A drinking mug in accordance with claim 7, including:

a cap removably secured to said vessel portion at the upper extent of said side wall.

11. A drinking mug in accordance with claim 10, wherein:

said cap defines a vent opening.

12. A drinking mug in accordance with claim 7 wherein:

said vessel portion and said straw portion are formed of transparent plastic material.

* * * * *